US005816631A

United States Patent [19]

Kochan

[11] Patent Number: 5,816,631

[45] Date of Patent: Oct. 6, 1998

[54] REMOVABLE BOTTLE HANDLE

[76] Inventor: Brian R. Kochan, 99 Rhatigan Road East, Edmonton, Albert, Canada, T6R 1N3

[21] Appl. No.: 788,606

[22] Filed: Jan. 24, 1997

[51] Int. Cl.[6] ..... B65D 23/10

[52] U.S. Cl. ..... 294/33; 215/396; 294/27.1

[58] Field of Search ..... 294/27.1, 28, 29, 294/31.1, 31.2, 32, 33; 215/396; 220/757–759; 248/145.6; D9/434, 435, 443, 455

[56] References Cited

U.S. PATENT DOCUMENTS

| | | | |
|---|---|---|---|
| D. 284,220 | 6/1986 | Pote | 294/33 X |
| 2,208,478 | 7/1940 | Simons et al. | 294/33 |
| 2,406,696 | 8/1946 | Leslie | 294/27.1 |
| 2,655,403 | 10/1953 | Ernest | 294/33 |
| 3,773,287 | 11/1973 | Hechinger | 294/31.2 X |
| 4,273,246 | 6/1981 | Thompson . | |
| 4,368,826 | 1/1983 | Thompson . | |
| 4,379,578 | 4/1983 | Schuler | 294/31.2 |
| 4,387,922 | 6/1983 | Geisinger | 294/31.2 |
| 4,552,396 | 11/1985 | Rais | 294/27.1 |
| 4,660,876 | 4/1987 | Weldin et al. | 294/33 |
| 4,723,801 | 2/1988 | Musumeci et al. | 293/33 |
| 4,865,208 | 9/1989 | Lax et al. | 294/33 X |
| 5,013,074 | 5/1991 | Galle | 294/33 |

FOREIGN PATENT DOCUMENTS

| | | | |
|---|---|---|---|
| 2056402 | 3/1981 | United Kingdom | 294/31.2 |
| 8302101 | 6/1983 | WIPO | 294/27.1 |

OTHER PUBLICATIONS

F.G.B. Ghidini Bepi (catalogue)—believed published 1995.
ADCO Inc Spectrum Catalogue—believed published 1995.

*Primary Examiner*—Johnny D. Cherry
*Attorney, Agent, or Firm*—George E. Fisk

[57] ABSTRACT

A removable handle for use with large soft drink bottles compressibly engages the circumference of the body of the bottle. The handle has a resilient, expandable bottle surrounding sleeve to engage the bottle with a hand grip extending outwardly therefrom.

10 Claims, 5 Drawing Sheets

FIG. 1
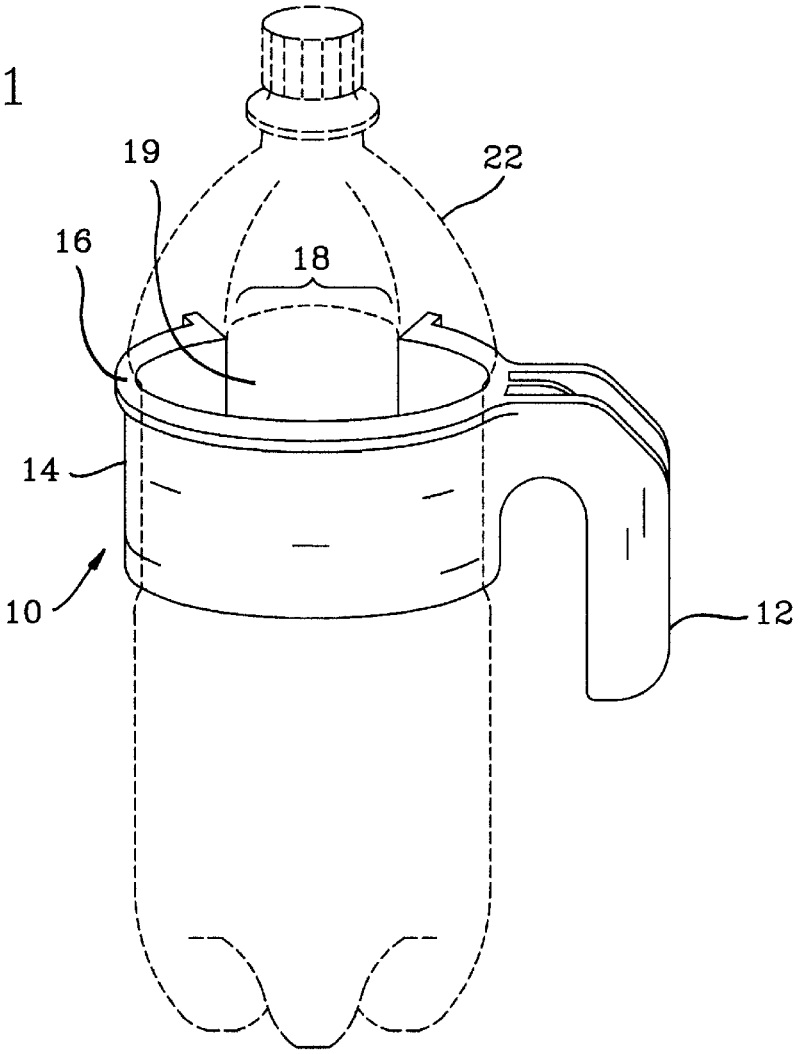
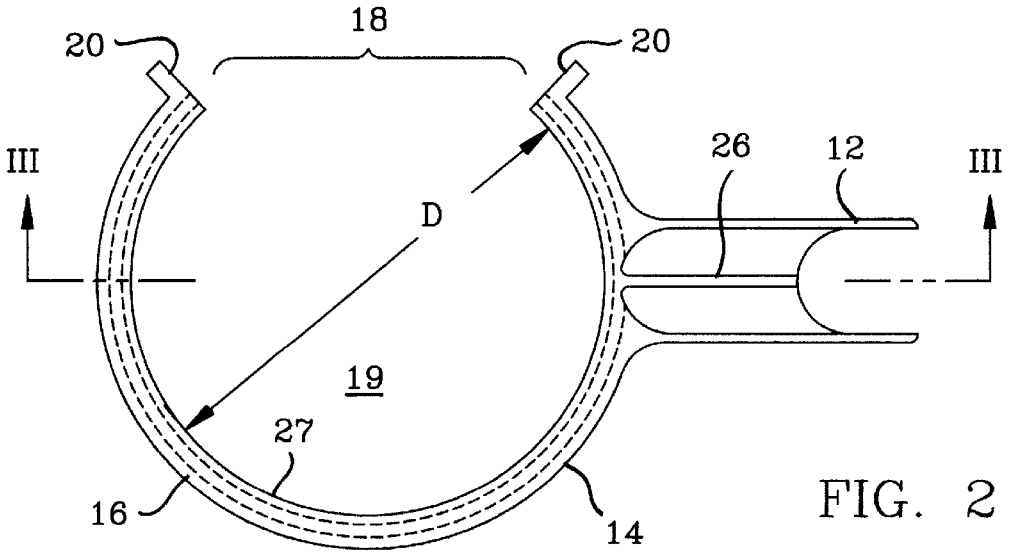
FIG. 2

REMOVABLE BOTTLE HANDLE

BACKGROUND TO THE INVENTION

1. Field of the Invention

This invention relates to attachable handles for fluid containers and more particularly to a removable handle mountable on a plastic soft drink bottle to aid in lifting the bottle and dispensing the contents thereof.

2. Description of the Prior Art

Distribution of soft drinks to the public often occurs in relatively large bottles such as two liter bottles constructed from a plastic material. These bottles have a substantial diameter making it difficult to grasp the bottle for pouring. The dimensions of the bottle make it particularly difficult for young children and the elderly to pour the fluids from the bottles.

To minimize the space required for transport and distribution of the bottles, such bottles are not provided with any form of handle. Such bottles have a generally cylindrical shape and are typically provided with a pouring spout having a threaded closure cap on the upper end and with a base portion upon which the bottle can rest.

A number of handles adapted to be fitted on such containers have heretofore been proposed. Examples of such prior art mountable handles include U.S. Pat. No. 4,273,246 to Thompson providing a handle which grips the neck region of the bottle and U.S. Pat. No. 4,379,578 to Schuler showing a handle mountable on a bottle gripping the neck and container portion of the bottle. Another mountable handle includes U.S. Pat. No. 4,552,396 to Rais showing an elongate removable handle which grips the foot and neck portion of the bottle.

The prior art handles for use on soft drink containers suffer from a tendency to allow full soft drink bottles to wiggle and move when gripped by the handle, leaving the user with an insecure feeling that the bottle may become dislodged from the handle. Furthermore, prior art handles do not provide a useful surface to which intelligible indicia, such as advertising media, can be affixed.

SUMMARY OF THE INVENTION

The present invention has in one of its aspects a removable handle to grippingly engage a bottle such as, for example, a plastic soft drink bottle. In another of its aspects, the invention provides a bottle surrounding surface upon which intelligible human readable indicia, such as advertising, can be affixed.

In another of its aspects the invention provides a removable handle for mounting on a bottle comprising resilient sleeve means to frictionally engage the body of a bottle, said resilient sleeve means forming a bottle retaining passage extending therethrough dimensioned to surroundingly engage a bottle to be retained therein, an expansion gap extending the length of said resilient sleeve means whereby said resilient sleeve means is expandable to receive a bottle within said bottle retaining passage and a hand grip outwardly extending from said resilient sleeve means.

BRIEF DESCRIPTION OF THE DRAWINGS

Further advantages of the invention will become apparent from the following description and the claims taken together with the accompanying drawings, in which:

FIG. 1 is a perspective elevation view of the preferred embodiment of the removable bottle handle.

FIG. 2 is a top plan view of the embodiment of FIG. 1.

DETAILED DESCRIPTION OF THE INVENTION

Figure 3:
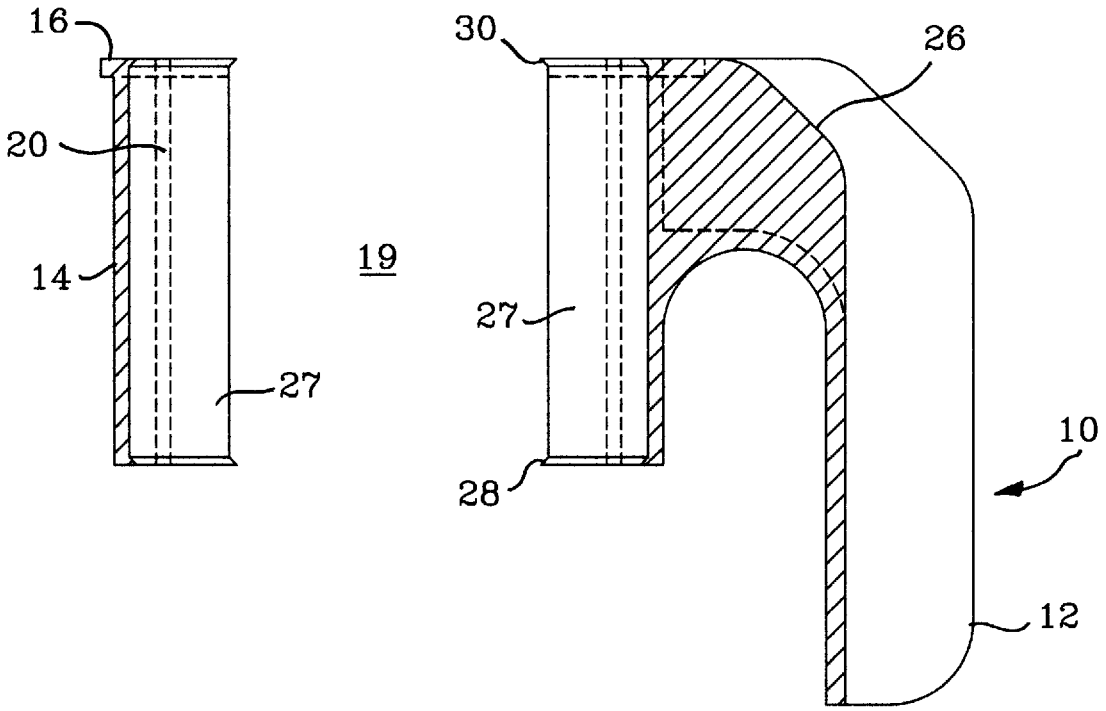
FIG. 3 is a sectional view taken along cutting line 3—3 of FIG. 2.

A preferred embodiment of the invention will now be described with reference to the drawings in which like reference numerals indicate like elements of the invention throughout the several views.

FIG. 1 shows the preferred embodiment of the removable handle in accordance with the present invention depicted generally by reference numeral 10. Removable handle 10 has a sleeve 14, hereinafter called the "bottle surrounding sleeve" having a hand grip 12 outwardly extending therefrom. Hand grip 12 is grasped by a person to pick up the removable handle 10 with bottle 22, shown in dashed-line silhouette form, retained therein as will be explained in more detail in the subsequent figures.

Sleeve 14 surrounds an interior volume which forms a bottle retaining passage 19. Bottle retaining passage 19 is dimensioned to grippingly engage the bottle to which removable handle 10 is affixed. Sleeve 14 is made of a resiliently deformable material and is interrupted along its length by an expansion gap 18 which permits the sleeve to be flexed and expanded to receive a bottle within the bottle retaining passage 19. Where the bottle to be retained has a cylindrical cross section, the sleeve forms a bottle retaining passage 19 which is preferably a substantially cylindrical shape having an inside diameter slightly less than the outside diameter of the bottle 22 which is to be grippingly retained therein.

Any suitable resilient material capable of plastic deformation may be used to form handle 10 including polyethylene, polypropylene of suitable density or plasticized polyvinyl chloride. Preferably, glass fibers are added to the plastic material to increase stiffness and to give strength during flexing. Suitable materials will be evident to persons skilled in the plastics art.

For retention of bottle 22 within handle 10 when pouring, it has been found that it is desirable to orient expansion gap 18 at substantially 90 degrees to the hand grip 12 when seen from above and to avoid having expansion gap 18 directly opposite (i.e. at 180 degrees to) hand grip 12.

Bottle surrounding sleeve 14 is preferably provided with a reinforcing ring 16 extending radially outwardly preferably from the top edge of bottle surrounding sleeve 14 to increase the ability of the bottle surrounding sleeve 14 to retain its shape under load, particularly to increase the gripping action of bottle surrounding sleeve 14 against any bottle 22 retained within the interior portion of the bottle surrounding sleeve.

FIG. 2 shows a top plan view of the embodiment of FIG. 1. Hand grip 12 is preferably formed in a hollow U-shaped channel member extending outwardly and downwardly from the upper portion of bottle surrounding sleeve 14. The upper portion of hand grip 12 can be provided with a reinforcing web 26 to increase the mechanical strength of the transition area between hand grip 12 and bottle surrounding sleeve 14 while minimizing the amount of material needed to construct the removable handle overall. Of course, other conventional hand grips can be used.

The bottle surrounding sleeve 14 defines an interior bottle retaining passage 19 having a circumference which is slightly smaller than the circumference of the bottle to be held therein. Where the bottle to be held has a circular cross section, as soft drink bottles do, then the interior bottle retaining passage 19 has a circular cross section of a diameter D which is slightly smaller than the outer diameter of the bottle to be grasped. For example, if the bottle to be grasped has a diameter of 4 inches, the inner diameter D of the bottle surrounding sleeve 14 can conveniently be 3⅞ inches or 3¾ inches. The bottle surrounding sleeve 14 has a expansion gap 18 for expansion of the bottle surrounding sleeve to permit the removable handle 10 to be flexed for mounting on a bottle to be held. The expansion gap size is not particularly important but should be less than one half of the circumference of the bottle retaining passage 19 to permit adequate gripping. An expansion gap 18 ranging in size from a simple slit in the bottle surrounding sleeve 14 up to 45 percent of the circumference of the bottle retaining passage 19 may be advantageously provided.

FIG. 3 shows a cross-section of FIG. 2 taken along cutting line 3—3. A bottle is retained within bottle retaining passage 19 by frictional contact with the interior surface 27 of the bottle surrounding sleeve 14. To more securely engage a bottle within the bottle surrounding sleeve 14, the inner surface of the bottle surrounding sleeve 14 is preferably provided with bottle gripping means, such as lower gripping rib 28 and upper gripping rib 30, to ensure firm engagement of the bottle within the removable handle. For circular cross section bottles, the interior surface 27 of the bottle surrounding sleeve 14 has an inner diameter D in the released state which diameter is smaller than the diameter of the bottle to be engaged. Where the bottle to be retained has a circular cross section, it has been found that a range of diameters of the bottle retaining passage 19 to the bottle of 0.85 to 0.98 provides the necessary gripping force.

Figures 4A, 4B, 4C:
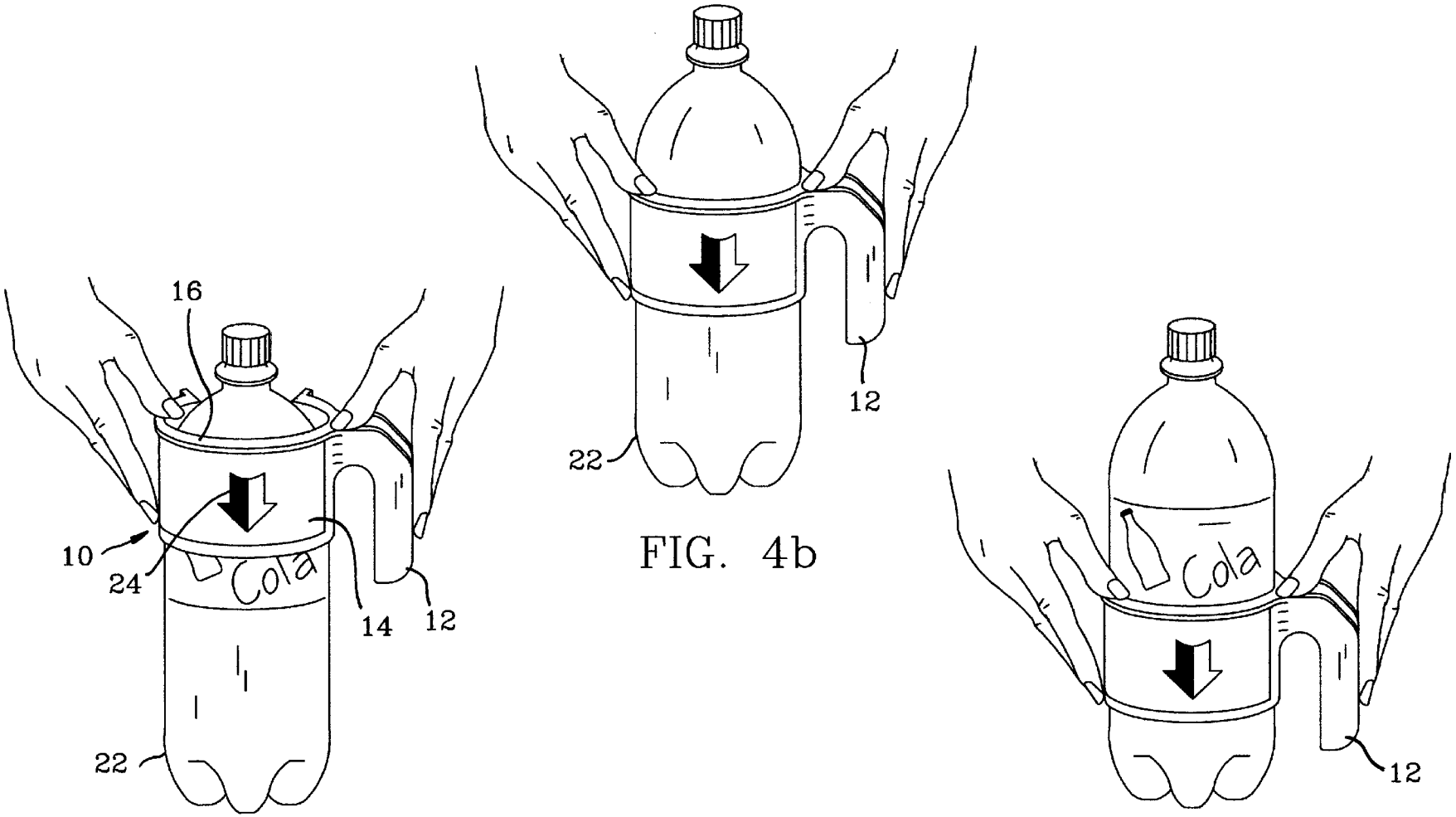
FIGS. 4*a*, 4*b* and 4*c* are perspective elevation views showing the handle respectively being mounted on, holding and being removed from a bottle.

Referring now to FIGS. 4*a*, 4*b* and 4*c*, operation of the removable handle is shown in three phases, namely: receiving a bottle 22, holding a bottle and being removed from a bottle. To mount the handle 10 on a bottle 22, the handle 10 is positioned on the upper portion of a bottle to be held as shown in FIG. 2*a*. The user then presses downwardly on the upper portion of the sleeve 14 causing the handle 10 to slide along the bottle to the mounted position on the bottle, namely, being positioned over the mid-portion of the bottle 22 as shown in FIG. 4*b*. To remove the handle 10 from bottle 22, the user presses downwardly on handle 10 urging it toward the base of the bottle as shown in FIG. 4*c*. To urge the handle 10 as near to the base of the bottle 22 as possible, the bottle may be positioned near the edge of a table (not shown) to enable hand grip 12 to extend beside the edge of the table top supporting the bottle.

To assist in mounting and removing the handle 10 in accordance with this manner of operation, the reinforcing ring 16 can provide a substantially flat upper surface for the user to press downwardly upon.

When a reinforcing ring 16 is present on the upper portion of the sleeve, then the lower portion of the bottle surrounding sleeve 14 is more flexible than the upper portion which is constrained by the reinforcing ring 16. As a result, the lower portion of the bottle surrounding sleeve 14 is more readily expandable to slidably receive a bottle. As the operator continues to push down, the sleeve under the ring is then urged outwardly by the fact that the portion of the sleeve in a downward direction from it but connected to it has already expanded. This helps overcome the resistance of the ring 16 to expansion.

Bottle surrounding sleeve 14 preferably provides an outer surface onto which intelligible human readable indicia 24, such as advertising messages or instructions, can be printed to promote events or articles. For example, in FIGS. 4*a*, 4*b* and 4*c*, a downwardly pointing arrow is depicted as indicia 24. When the removable handle is mounted on the bottle 22, which position is shown in FIG. 4*b*, the intelligible human readable indicia 24 on the removable handle 10 completely cover any advertising messages or printed information recorded on the central portion of bottle 22. As a result, the user sees the intelligible indicia 24 on the outer surface of removable handle 10 rather than any advertising on the central portion of the bottle.

Figure 5:
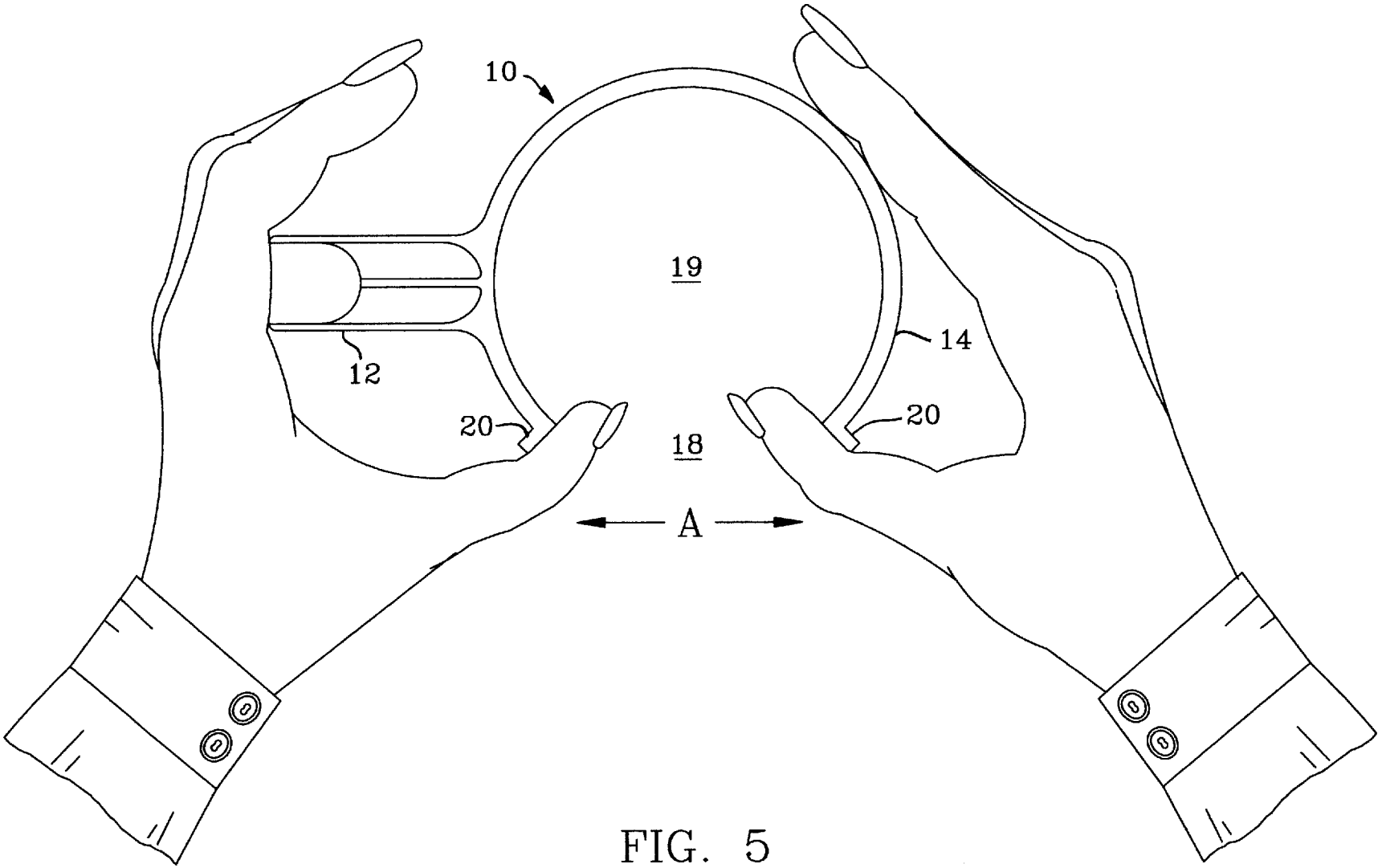
FIG. 5 is a top plan view showing an operator flexing of the removable handle to receive a bottle therein.

FIG. 5 shows a top plan view of the preferred embodiment of the removable handle 10 and depicts another manner of flexing the bottle surrounding sleeve 14 to slidably receive or remove a bottle therein. The end portions of the bottle surrounding sleeve 14 on opposing sides of the expansion gap 18 can be depressed in the direction shown by double headed arrow "A" to flex the bottle surrounding sleeve 14 thereby increasing its inside diameter by inducing the expansion gap 18 to widen. When flexed in this manner, removable handle 10 can easily be slidably positioned over a bottle in a manner analogous to FIG. 4*a*. For ease of use in imparting this flexing action to the bottle surrounding sleeve 14, the end portions of the bottle surrounding sleeve on either side of the expansion gap 18 can be provided with tabs 20 to allow the operator to flex the bottle surrounding sleeve more readily thereby increasing its inside diameter for mounting or removing a bottle from removable handle 10. With this manner of construction, removable handle 10 can be placed on a bottle in either of two different ways whichever is more convenient to the user of the handle, i.e. it can be pushed downwardly as shown in FIG. 4*a* or the tabs 20 can be pushed outwardly as shown in FIG. 5 while the sleeve is slid over the top of the bottle.

Figure 6:
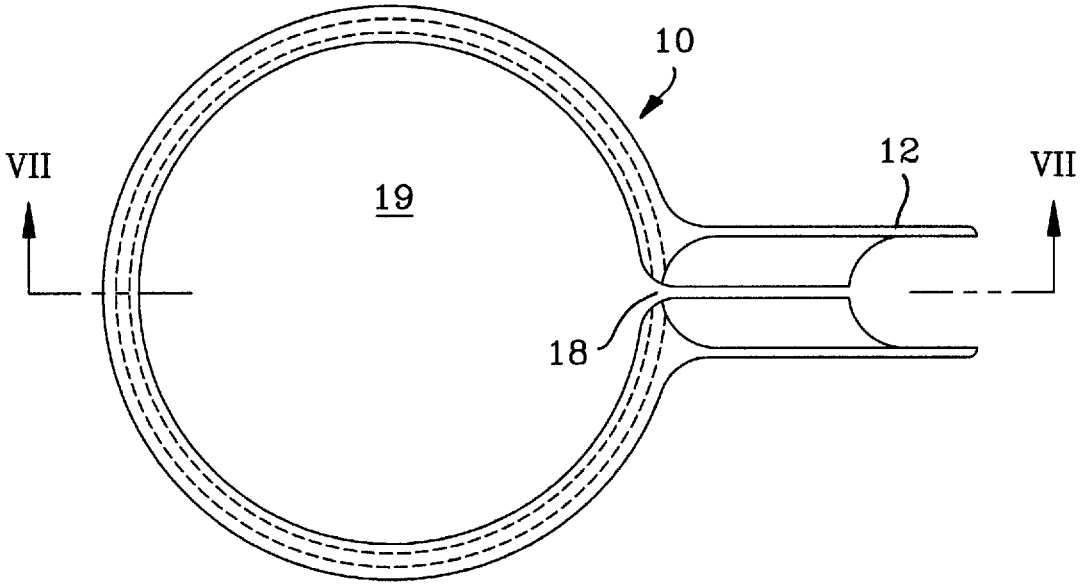
FIG. 6 is a top plan view of a second embodiment of the handle.

FIG. 6 shows a top plan view of a second embodiment of the removable handle 10. In this embodiment, the expansion gap 18 is located in the center portion of handgrip 12. By providing the expansion gap 18 in this portion of the removable handle, it is possible to use a less rigid construction for the bottle surrounding sleeve 14 while maintaining a positive engagement between the removable handle 10 and the bottle disposed therein as the operator will force the expansion gap 18 to tend to close by picking up the hand grip 12 to pour the bottle. In this embodiment, the expansion gap 18 is very small, so that a person can grasp handle portions on each side of the gap using the same hand. This embodiment of the invention is not preferred.

Figure 7:
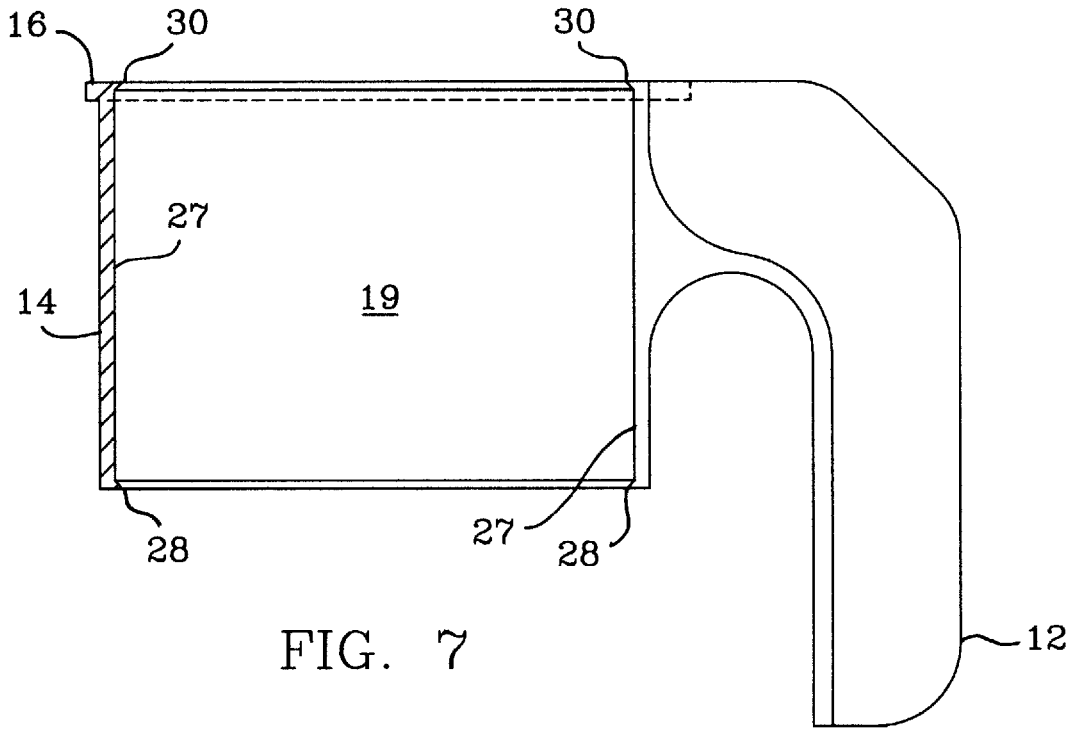
FIG. 7 is a sectional view taken along cutting line 7—7 of FIG. 6.

FIG. 7 is a cross sectional view taken along cutting line 7—7 of FIG. 6 with like features of the invention identified by the same reference numbers as used in the other figures herein.

While the invention has been described in relation to its preferred embodiment and variations thereof, the invention in its broader aspect is not limited to these specifically described embodiments and departures may be made therefrom which are within the scope of the accompanying claims without departing from the principles of the invention disclosed herein.

I claim:

1. A removable handle for a bottle, which comprises:

a sleeve of substantially rigid but resiliently deformable material, having a cross-section which approximates the cross-section of the bottle with which it is to be used, but which is slightly smaller than said bottle in at least one cross-sectional dimension, said sleeve having an upper portion and a lower portion, said upper portion being less deformable than the lower portion thereof such that the sleeve can be slid over a bottle from above to fit over the body of a bottle and frictionally engage same with its interior against the exterior of the bottle over a surface area intermediate between the top and bottom of the bottle, means allowing resilient deformation of said sleeve, and a handgrip extending from the exterior of the sleeve.

2. A handle as claimed in claim 1, in which said means allowing resilient deformation includes an expansion gap defined by two separated portions of the sleeve, said gap extending completely through the sleeve from top to bottom.

3. A handle as claimed in claim 2, for use with a bottle which has a circular cross section of substantially constant diameter for a major portion of its length, in which the cross-section of the sleeve is circular and has a diameter which is slightly smaller than the diameter of said circular cross-section of the bottle.

4. A handle as claimed in claim 3, in which the diameter of the sleeve is from 85 percent to 98 percent of the diameter of the circular cross section of the bottle.

5. A handle as claimed in claim 3, in which said gap extends over from 1 percent to 45 percent of the circumference of the circular cross-section of the bottle when said handle is mounted on said bottle and viewed from above.

6. A handle as claimed in claim 2, in which said gap is oriented at substantially 90 degrees to said handgrip when the handle is viewed from above.

7. A handle as claimed in claim 2 wherein the portion of said sleeve defining said gap includes tabs extending outwardly from said sleeve whereby said tabs may be pushed to expand said sleeve.

8. A handle as claimed in claim 1, additionally having bottle gripping means in the inside of the sleeve.

9. A handle as claimed in claim 1, wherein the portion which is less deformable comprises a circumferential resilient reinforcing rib in the exterior of the sleeve, towards the upper portion of such sleeve as oriented when in place on a bottle, to aid in urging the sleeve to grip resiliently against the bottle.

10. A handle as claimed in claim 1, additionally comprising human-readable indicia on the exterior of the sleeve.

* * * * *